US008368603B2

(12) United States Patent
Huang

(10) Patent No.: US 8,368,603 B2
(45) Date of Patent: Feb. 5, 2013

(54) FLEXIBLE ANTENNA DEVICE

(75) Inventor: Hung-Ming Huang, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 366 days.

(21) Appl. No.: 12/794,794

(22) Filed: Jun. 7, 2010

(65) Prior Publication Data

US 2011/0169699 A1 Jul. 14, 2011

(30) Foreign Application Priority Data

Jan. 11, 2010 (TW) ..... 99100597 A

(51) Int. Cl.
*H01Q 1/24* (2006.01)

(52) U.S. Cl. ..... 343/702; 343/700 MS

(58) Field of Classification Search ..... 343/702, 343/700 MS, 900, 715
See application file for complete search history.

(56) References Cited

U.S. PATENT DOCUMENTS 7,463,202 B2 * 12/2008 Zarnowitz et al. ..... 343/702

* cited by examiner

*Primary Examiner* — Hoang V Nguyen
(74) *Attorney, Agent, or Firm* — Winston Hsu; Scott Margo

(57) ABSTRACT

A housing of an antenna device is made of a flexible material and contains the FPC-type antenna therein. The antenna device may be mounted to a PCB assembly of an electronic device, either detachably or fixedly. The housing and the antenna may both be all made of a flexible material, or the housing may further use a base made of a rigid material to mount to the PCB assembly, while the antenna may also be hybrid circuit board. As the antenna device is moved out of the shielding area of a metal housing of the electronic device for use, the flexibility of the antenna device keeps the antenna device from cracking due to external force and increases the durability of the antenna device.

14 Claims, 6 Drawing Sheets

FLEXIBLE ANTENNA DEVICE

BACKGROUND OF THE INVENTION

1. Field of the Invention

The invention relates to an antenna device and an electronic device, and more particularly, to a flexible antenna device having a hard base and a soft body and an electronic device having said antenna device.

2. Description of the Prior Art

Electronic devices such as notebooks or tablet PCs are generally equipped with WWAN antenna device for transmitting/receiving wireless signals. The wireless signal is likely to be shielded by a metal housing of the computers. Hence, mechanism such as a hinge is commonly applied to the antenna device to rotate the antenna device out of the shielding area of the metal housing of the computer to function normally.

Conventional antenna device is usually rigid cased. As it is rotated out of the housing of the computer for use, the antenna device is vulnerable to external forces and ends up cracking. Although other types of antenna device are made of flexible material and is deformable, making it away from cracking due to external forces, the flexible printed circuit (FPC) inside the antenna device is also very easily to deform after bending of the antenna device, which causes the coupling ends between the antenna device and the printed circuit board assembly (PCBA) difficult, even unable, to couple together.

SUMMARY OF THE INVENTION

The invention provides an antenna device. The antenna device includes an antenna having a feeding part, a connecting structure made of a rigid material, and a housing made of a flexible material. The antenna is partially contained in the housing and the housing is assembled with the connecting structure.

The invention also provides an electronic device having flexible antenna device. The electronic device includes a device body, a connecting structure configured on the device body and including a printed circuit board (PCB), and an antenna device connected to the PCB. The antenna device includes an antenna that is a flexible printed circuit (FPC) and having a feeding part, and a housing made of a flexible material. The antenna is contained in the housing and the housing is assembled with the connecting structure so as to connect to the PCB.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
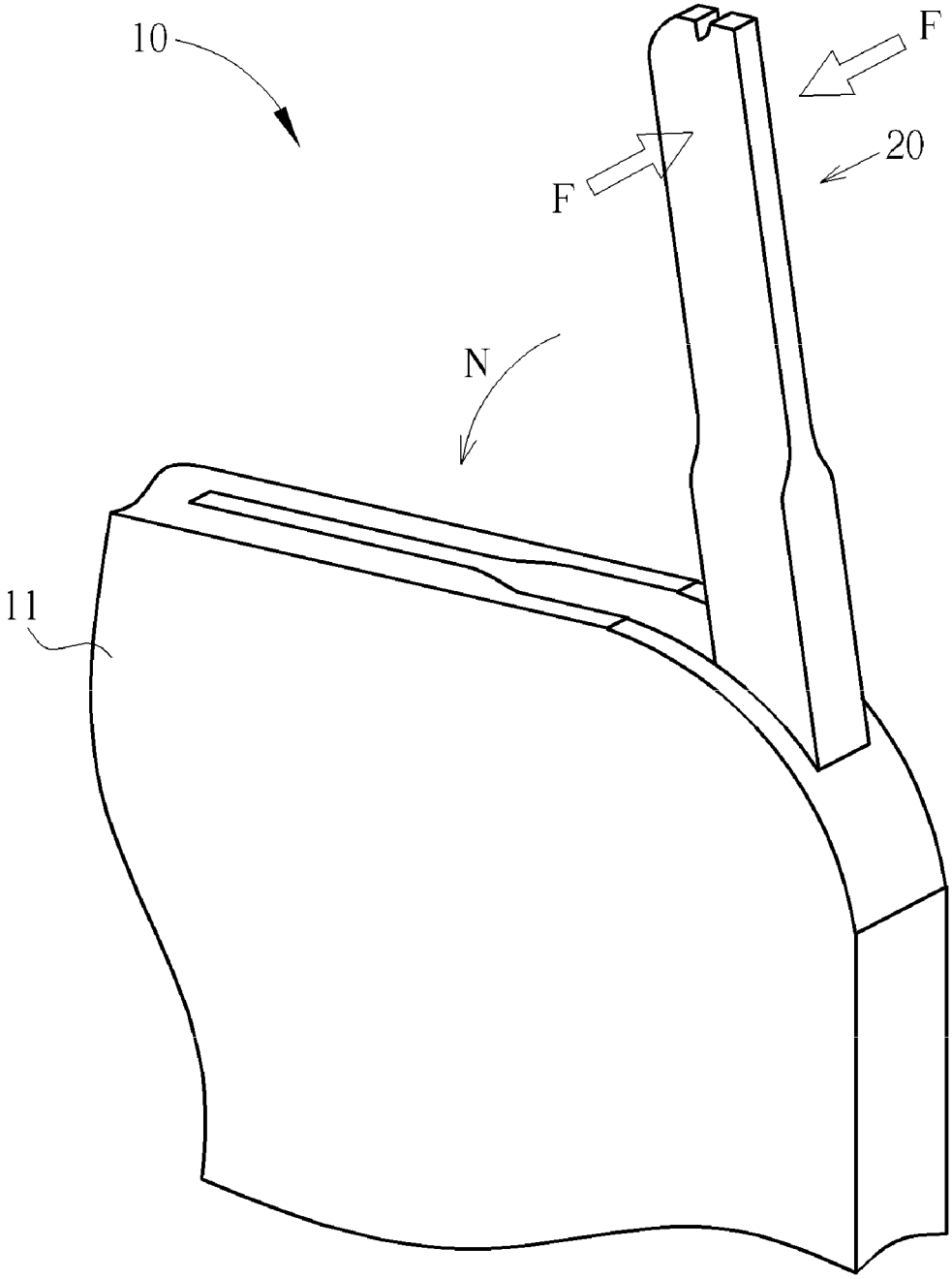
FIG. 1 is a schematic diagram showing partial view of an electronic device having a flexible antenna device according to an embodiment of the invention.

Please refer to FIG. 1. FIG. 1 is a schematic diagram showing partial view of an electronic device 10 having a flexible antenna device 20 according to an embodiment of the invention. The antenna device 20 is a WWAN antenna device or wireless antenna device of any available standard. The electronic device 10 may be a notebook PC, a tablet PC, or any electronic product with wireless transmission. In the embodiment in FIG. 1, the antenna device 20 is configured on a body 11 of the electronic device 10 in a pivotable way, while in other embodiments of the invention, the antenna device 20 may also be realized by being pulled out from the body 11. The antenna device 20 can be stored in the housing 11 by rotating along direction N or moved out of the shielding area of the metal housing 11 of the electronic device 10 to get to work, as shown in FIG. 1. As the antenna device 20 is configured at the using position as shown in FIG. 1, its feature of flexibility protects the antenna device 20 from cracking when exerted with external forces F.

Figure 2:
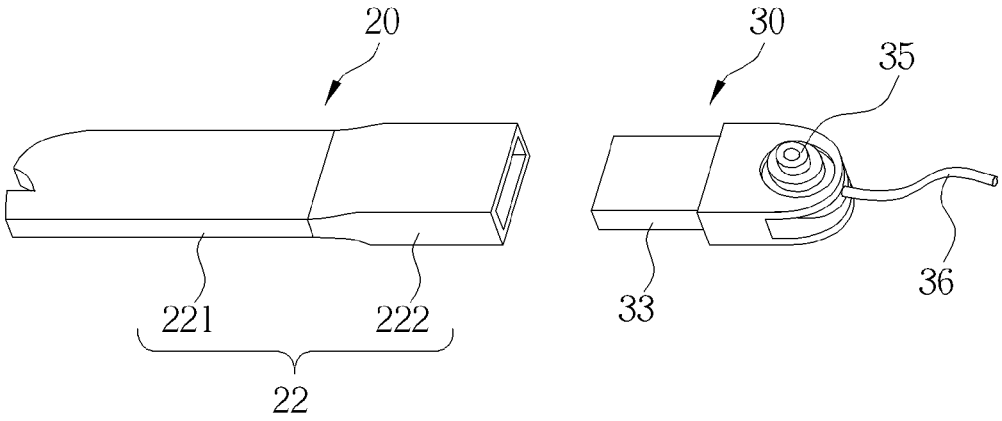
FIG. 2 is a schematic diagram showing the antenna device and a connecting structure of the electronic device.
Figure 3:
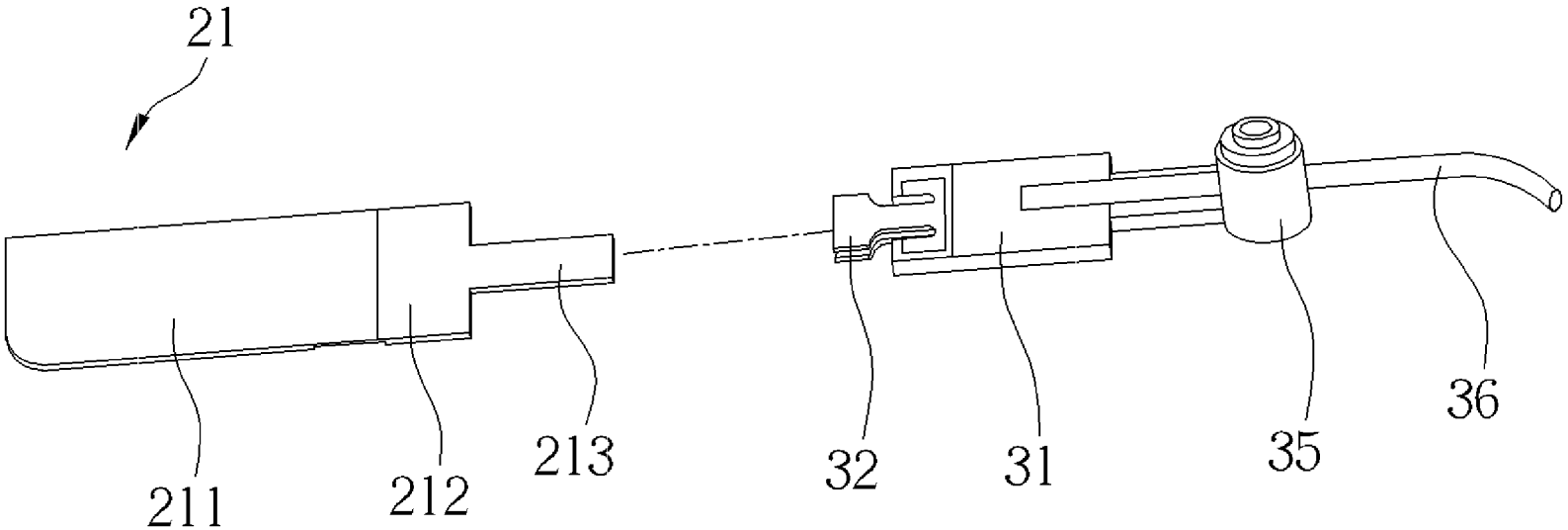
FIG. 3 is a schematic diagram showing an antenna of the antenna device and a printed circuit board (PCB) of the connecting structure.

Please refer to FIG. 2 and FIG. 3. FIG. 2 is a schematic diagram showing the antenna device 20 and a connecting structure 30 of the electronic device 10 and FIG. 3 is a schematic diagram showing an antenna 21 of the antenna device 20 and a printed circuit board 31 (PCB) of the connecting structure 30. The antenna device 20 includes the antenna 21 and a housing 22 (or further includes a cover 33 of the connecting structure 30). In this embodiment, the antenna 21 has a first section 211, a second section 212, and a feeding part 213. The first section 211 is a flexible printed circuit (FPC), the second section 212 is a rigid circuit board, and the feeding part 213 is configured on the rigid circuit board. Hence, in the embodiment in FIG. 2 and FIG. 3, the antenna 21 is hybrid with a flexible section and a rigid section. The connecting structure 30 includes a circuit board 31 and a coupling end 32 on the circuit board 31. The circuit board 31 further connects to a hinge structure 35 and electrically to a main board (not shown in the figures) of the electronic device 10 via a signal wiring 32. The hinge structure 35, the circuit board 31, and the coupling end 32 are contained in a cover 33. When the antenna device 20 is detachably connected to the connecting structure 30, the feeding part 213 of the antenna 21 couples with the coupling end 32. In this embodiment, the coupling end 32 is a metal clip, while the feeding part 213 is a metal piece, or vice versa in other embodiments. As the feeding part 213 couples with the coupling end 32, the antenna device 20 has connection with the system in the electronic device 10 and serves as a transceiver/receiver. The hinge structure 35 is configured on the body 11 of the electronic device 10 and the antenna 30 is therefore pivotable relative to the body 11 of the electronic device 10 via the connecting structure 30.

The antenna 21 is partially contained in the housing 22, which is made of a flexible material in this embodiment and can bear external force as shown in direction F in FIG. 1 and deforms restorably so as not to crack the antenna device 20. In this embodiment, the housing 22 includes a soft section 221 and a base 222, which are combined together by double injection or bonding. The soft section 221 is made of a flexible material and the base 222 is made of a rigid material, such as ABS or PC. As a result, the antenna device 20 can have both the flexibility to bear external forces and rigidity to fixedly assemble with the connecting structure 30. As FIG. 2 shows, the antenna 20 connects to the connecting structure 30 by the base 222 assembling with the cover 33.

Figure 6:
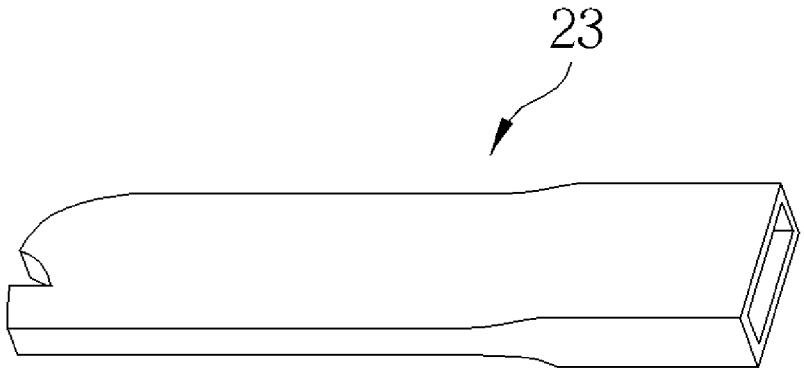
FIG. 6 is a schematic diagram of another embodiment of the housing of the antenna device.

Besides the embodiment shown in FIG. 2 and FIG. 3, the antenna 21 may also be exemplified as a total flexible printed circuit (FPC) in other embodiments of the invention, where the feeding part 213 extends from the FPC and the housing 23 is totally made of a flexible material, which is shown in another embodiment in FIG. 6. The antenna device 20 is connected to the connecting structure 30 by directly assembling the housing 23 with the cover 33. The antenna device 20 may also directly extend from the circuit board 31 other than detachably connecting to the connecting structure 30.

Figure 4:
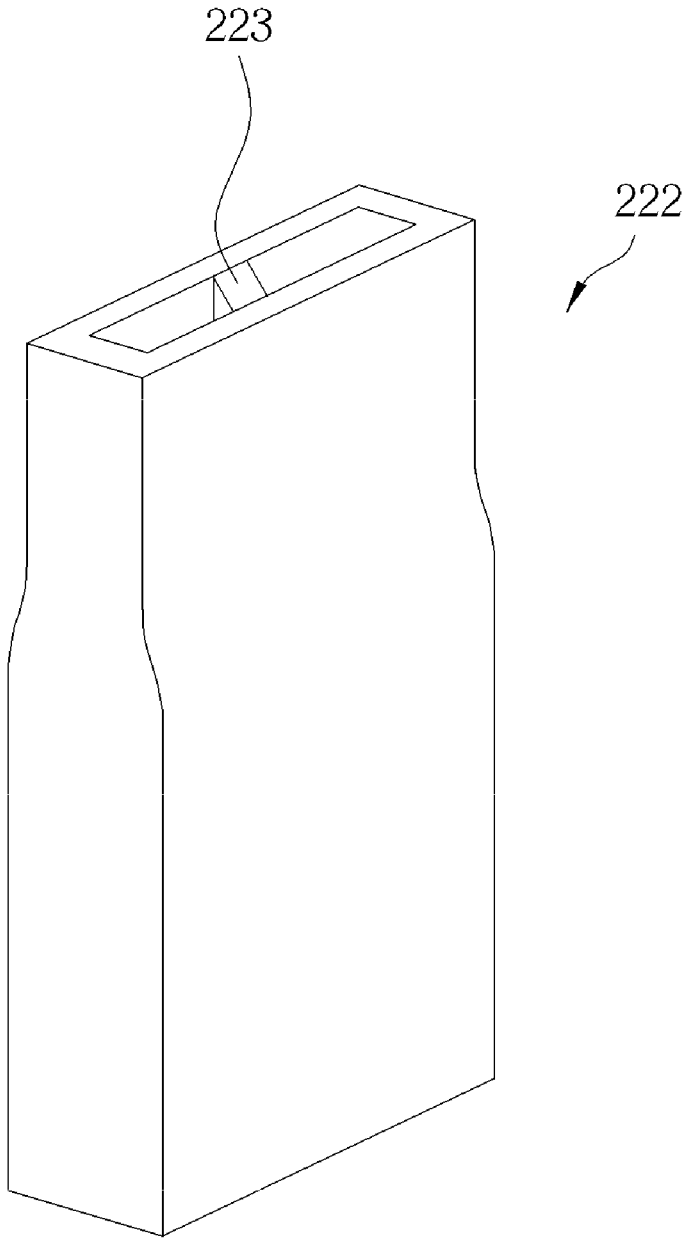
FIG. 4 is a schematic diagram of the base of the antenna device.
Figure 5:
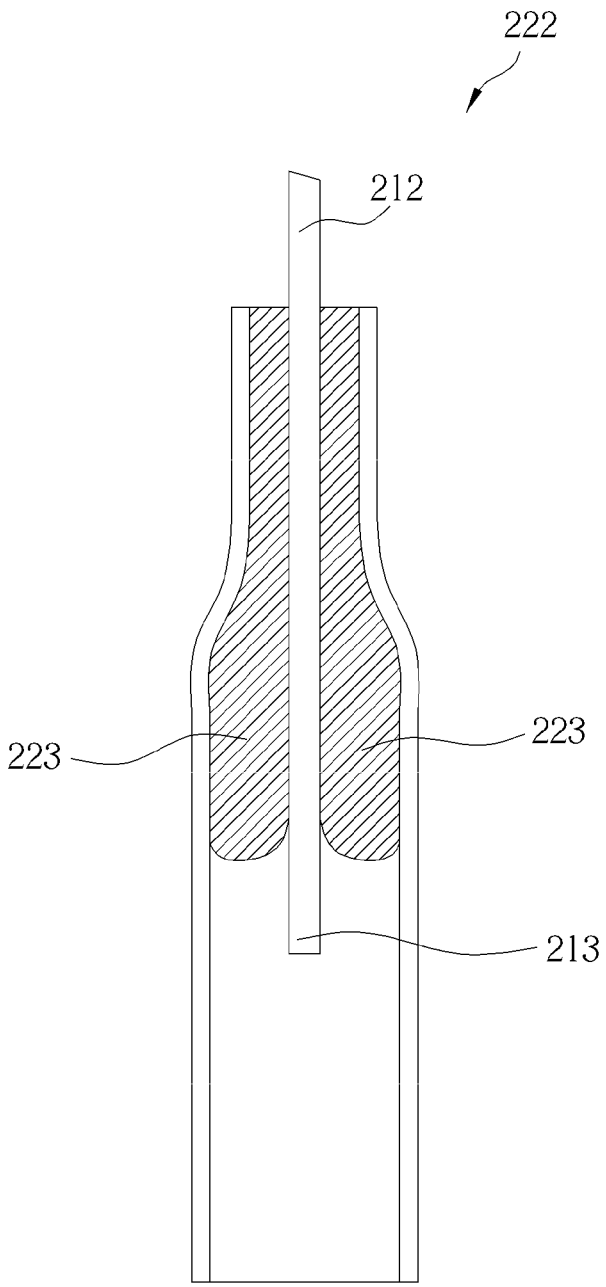
FIG. 5 is a schematic diagram showing cross-section view of an body and a base of the antenna.

Please refer to FIG. 4 and FIG. 5. FIG. 4 is a schematic diagram of the base 222 of the antenna device 20 and FIG. 5 is a schematic diagram showing cross-section view of the base 222, the second section 212 of the antenna 21, and the feeding part 213. Since the feeding part 213 has to precisely connect to the coupling end 32 of the circuit board 31 so as to normally install the antenna device 20, the feeding part 213 should be positioned when the antenna device 20 is being assembled with the connecting structure 30. Hence, the base 222 (or the housing 23 in the embodiment in FIG. 6) further has two ribs 223 protruding at both inner walls that contain the antenna 21 to hold and position the feeding part 213 when the antenna 21 is contained in the housing 22. Also when the antenna device 20 is deformed due to the external force F, the feeding part 213 is still held in position by the ribs 223. Precise insertion and coupling of the feeding part 213 to the coupling end 32 is achievable due to the confinement of the ribs 223.

The flexible antenna device and the electronic device having such antenna device disclosed in the invention provide the housing that is made of a flexible material and contains the FPC-type antenna therein. The antenna device may be mounted to a PCB assembly of the electronic device, either detachably or fixedly. The housing and the antenna may both be all made of a flexible material, or the housing may further use the base made of a rigid material to mount to the PCB assembly, while the antenna may also be hybrid circuit board. As the antenna device is moved out of the shielding area of a metal housing of the electronic device for use, the flexibility of the antenna device keeps the antenna device from cracking due to external force and increases the durability of the antenna device.

Those skilled in the art will readily observe that numerous modifications and alterations of the device and method may be made while retaining the teachings of the invention.

What is claimed is:

1. An antenna device, comprising:
an antenna comprising a feeding part;
a connecting structure made of a rigid material; and
a housing made of a flexible material, wherein the antenna is partially contained in the housing and the housing is assembled with the connecting structure, wherein the housing comprises a rib for holding the antenna and for positioning the antenna when the housing is assembled with the connecting structure.

2. The antenna device of claim 1, wherein the antenna comprises a rigid printed circuit board (PCB) which the feeding part is configured thereon.

3. The antenna device of claim 1, wherein the housing further comprises a base made of a rigid material and the housing is assembled with the connecting structure via the base.

4. The antenna device of claim 3, wherein the base of the housing and a flexible section of the housing are combined by double injection or bonding.

5. An electronic device having flexible antenna device, comprising:
a device body;
a connecting structure configured on the device body and comprising a printed circuit board (PCB), wherein the connecting structure is a hinge structure that is relatively pivotable to the device body; and
an antenna device connected to the PCB and comprising:
an antenna that is a flexible printed circuit (FPC) and comprising a feeding part; and
a housing made of a flexible material, wherein the antenna is contained in the housing and the housing is assembled with the connecting structure so as to connect to the PCB.

6. The electronic device of claim 5, wherein the antenna device is connected to the printed circuit board in a detachably way.

7. The electronic device of claim 5, wherein the antenna comprises a rigid PCB which the feeding part is configured thereon.

8. The electronic device of claim 5, wherein the housing comprises a rib for holding the antenna and for positioning the antenna when the housing is assembled with the connecting structure.

9. The electronic device of claim 5, wherein the housing further comprises a base made of a rigid material and the housing is assembled with the connecting structure via the base.

10. The electronic device of claim 9, wherein the base comprises a rib for holding the antenna and for positioning the antenna when the housing is assembled with the connecting structure.

11. The electronic device of claim 9, wherein the base of the housing and a flexible section of the housing are combined by double injection or bonding.

12. The electronic device of claim 5, wherein the PCB comprises a coupling end for coupling with the feeding part.

13. The electronic device of claim 5, wherein the electronic device is a notebook PC or a tablet PC.

14. An antenna device, comprising:
an antenna comprising a feeding part;
a connecting structure made of a rigid material; and
a housing made of a flexible material and comprising a base made of a rigid material, wherein the antenna is partially contained in the housing and the housing is assembled with the connecting structure via the base.

* * * * *